United States Patent [19]

Peterson

[11] 4,392,033

[45] Jul. 5, 1983

[54] CENTRIFUGAL SWITCHING SYSTEM

[75] Inventor: Francis C. Peterson, St. Charles, Ill.

[73] Assignee: Illinois Tool Works, Inc., Chicago, Ill.

[21] Appl. No.: 251,430

[22] Filed: Apr. 6, 1981

[51] Int. Cl.[3] ..... H01H 35/10

[52] U.S. Cl. ..... 200/80 R; 310/68 E; 73/538

[58] Field of Search ..... 200/80 R, 85 R; 318/325, 793; 310/68 E; 73/535, 536, 537, 538

[56] References Cited

U.S. PATENT DOCUMENTS

| | | | |
|---|---|---|---|
| 1,713,148 | 5/1929 | Schild . | |
| 1,713,203 | 5/1929 | Welch . | |
| 2,426,840 | 9/1947 | Nye et al. | 200/80 |
| 2,663,771 | 12/1953 | Hartz | 200/80 |
| 2,715,528 | 8/1955 | Schulte | 200/80 R |
| 2,857,490 | 10/1958 | Heckethorn | 200/80 R |
| 2,903,535 | 9/1959 | Sparklin | 200/80 R |
| 3,154,650 | 10/1964 | Brucken | 200/80 R |
| 3,348,420 | 10/1967 | Schlirf | 73/538 |
| 3,514,649 | 5/1970 | Nomura | 310/68 E |
| 3,532,841 | 10/1970 | Hackbardt | 200/80 |
| 3,868,855 | 3/1975 | Murphy, Jr. | 73/536 |
| 4,208,559 | 6/1980 | Gray | 200/80 |
| 4,333,343 | 6/1982 | Czuszak | 73/538 |

*Primary Examiner*—G. P. Tolin

*Attorney, Agent, or Firm*—Jerold M. Forsberg; Thomas W. Buckman

[57] ABSTRACT

A switch actuating device designed to control the speed of rotation of shafts, particularly electric motor shafts. A plastic hub section is designed to be positioned about the shaft, and a plurality of relatively independent, flexing leg, weight members, radially disposed from the hub and integrally connected to the hub by a thin web section, create the actuating members for acting on a switch which directly controls the rotation of the shaft. The web section is dome-like in configuration so that the top regions of the legs are at an axial plane below the uppermost region of the hub and is so designed to permit the legs to force the web upwardly snappingly into contact with the independent switch member.

13 Claims, 6 Drawing Figures

CENTRIFUGAL SWITCHING SYSTEM

BACKGROUND OF THE INVENTION

This invention relates generally to centrifugal switch activating devices and more particularly to an integral switch activating device for controlling the rotational speed of a motor shaft.

There have been a large variety of centrifugal activating devices for controlling a switch so as to limit the speed of a shaft. Typical of such devices are multi-part metal members which utilize weight devices designed to be radially expanded against a bias of a coil spring or the like. These prior art devices are costly and inherently produce a large amount of noise in operation due to the various movements of the multiple parts.

Other such devices rely upon an axial movement on the shaft of an actuating member, responsive, of course, to the rotational speed of the shaft. This type of device, obviously, creates significant wear on both the shaft and the member, and with time develops noises and inefficiencies in sensing and controlling the rotational speed of the shaft in a predetermined manner.

SUMMARY OF THE INVENTION

It is a principle object of this invention to provide an integral, unitary switch activating device which reliably actuates a switch at a predetermined angular velocity of a shaft.

A further object of this invention is to provide a quiet operating switching member; the leg members being designed to reduce the noise generally accompanying a switch of this type.

A particular advantage of this invention is the ability of the leg weights to respond relatively independently of one another to the initial phases of the centrifugal forces and, subsequent to the initial phase, to act in unison to change the axial location of the outer regions of the switching member so as to actuate a switch.

In achieving the objects and advantages of the invention, the switch member of the present invention is constructed of a unitary configuration to eliminate the relative movement of the various elements, and more particularly is constructed of a thermoplastic material in the hub and leg, weight member regions. The hub member and the weight members are integrally connected, in the preferred embodiment, by a very thin web region of sheet metal, preferably stainless steel. The web is dome-shaped so that the outer regions of the web are at a lower axial location than the inner regions. The leg, weight members are pendantly connected to the outer periphery of the web and are designed to independently flex or pivot relative to one another so that the centrifugal action applied to the weight members creates an initial splaying or radially outwardly moving action on the lower regions thereof, with the upper regions also free to act independently applying a plurality of independent forces on the outer regions of the web. The initial movement of the legs blends into a second stage action on the outer periphery of the web to snap, i.e., move over center, the entire outer periphery upwardly in a uniform manner.

DETAILED DESCRIPTION OF THE PREFERRED EMBODIMENT

Figure 1:
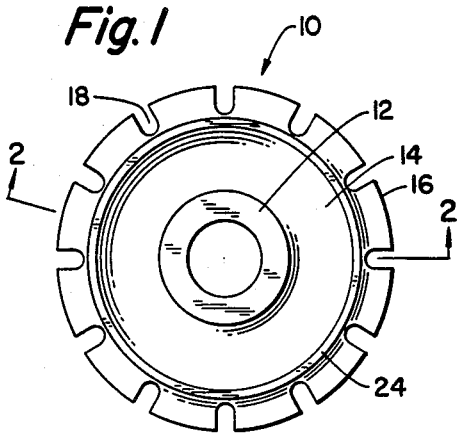
FIG. 1 is a top plan view of the unitary switch activating member of the present invention.
Figure 2:
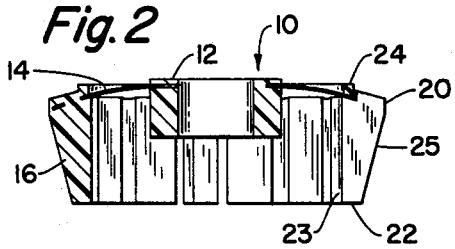
FIG. 2 is a cross-sectional view of the switch member as taken along Lines 2—2 of FIG. 1.
Figure 3:
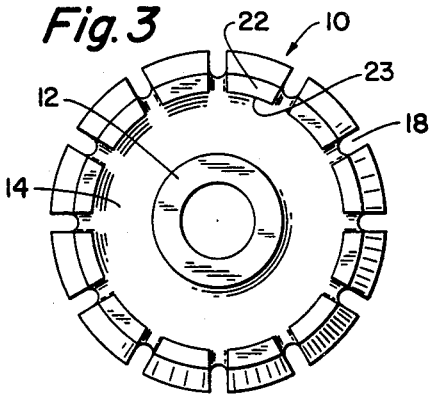
FIG. 3 is a bottom plan view of the switch activating element of FIG. 1.

Turning now to the drawings, and more particularly to FIGS. 1 through 3, it will be shown that the unitary, centrifugal switching member 10 basically comprises three elements; namely, a hub member 12 of predetermined axial extent and radial thickness, a plurality of spaced leg members 16 positioned about the outer periphery of a web member 14 creating a necessary predetermined radial spacing between the hub and the legs. It is important to note that both the hub 12 and the legs 16 are of a molded plastic material and are essentially unitized with the spring steel web 14. The use of a moldable plastic material in the hub and the leg reduces the noise and excessive wear generally accompanying such a multi-piece centrifugal switching member.

The web member 14 is generally dome-like with its innermost region being apertured and at an axial location higher than the outermost periphery. In the preferred embodiment of FIGS. 1 through 3, the hub 12 and the plurality of legs 16 are molded in place around the inner periphery of the web and the outer periphery of the web, respectively, creating a unitary member. In this preferred embodiment, each of the plastic leg members have a portion interconnected by plastic above and below the web. The individual leg members are interconnected above the web 14 by a rib 24, the purpose of which will be discussed later. The inner surface of the legs 23 is preferably parallel to the outer surface of the hub, and the composite of the inner surfaces 23 creates a cylinder when the member is at rest. However, it should be noted that the outer surface 25 of the legs in the composite creates a frusto-conical configuration with the smallest diameter at the lowest regions 22 of the legs and the largest diameter at the upper regions 20 of the legs. This creates each leg in the form of a wedge with the greatest thickness at the top and the minimum thickness at the bottom. It is important to also note that the cross-section of the legs in the radial dimension are also wedge shaped. This can be most clearly shown in FIG. 3 with the cross-section in the axial dimension shown in FIG. 2.

Again directing attention to the configuration of the legs in FIGS. 2 and 3, the legs are separated circumferentially from one another by radially, inwardly extending slots 18 in the web member. The radial extent of the slots 18 is less than the radial extent of the uppermost region of each leg. Thus, the outer regions of each leg are free to flex axially relative to one another while the inner, upper regions of each leg are essentially interconnected to one another. In operation, as the member 10 is rotated about a central axis, the centrifugal force tends to force the lower regions 22 of each leg outwardly. This outward movement must necessarily create a bending or pivoting action on the outer periphery of the web. The initial reaction to the centrifugal force permits the outer radial regions separated by the slots 18 to flex upwardly relatively independent of one another. However, as the centrifugal force creates a larger radial displacement of the lower regions, the continuing pivotting of the legs must necessarily react against the outer periphery of the web since the innermost regions of the upper portion of the legs and the outer periphery of the web are essentially unitary. The momentum of the individual acting legs followed by the unitary action creates a consistent upward snapping force on the outer regions of the web. As is clearly seen in FIG. 6 the web member moves, i.e., snaps, from the solid line position, over center, to the dotted line position, for reasons which will be discussed later.

Figure 6:
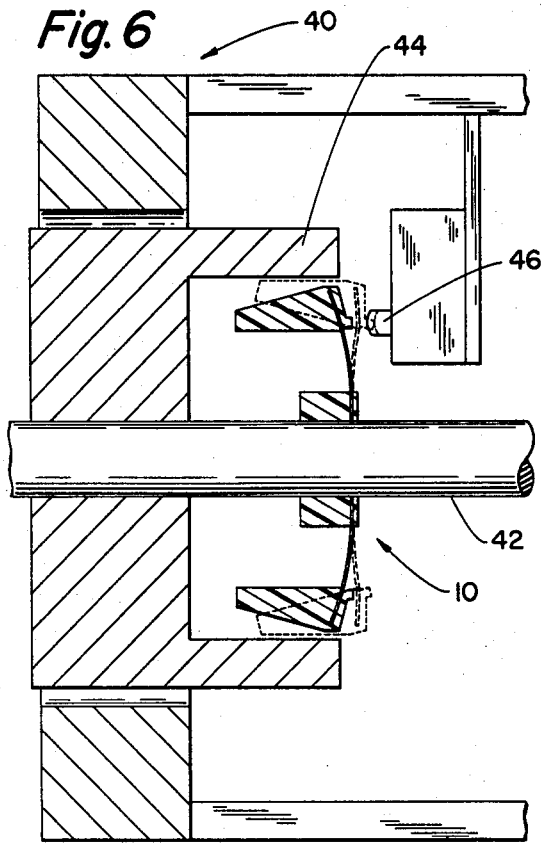
FIG. 6 is a schematic view of a switch element of this invention in use as attached to a shaft in a motor.

Turning now to FIG. 6, it will be seen that as the predetermined centrifigual force exerted on member 10, by rotating shaft 42, the legs 16 will exert, at their innermost upper regions, forces on the web to uniformly and predictably snap the web over center so that it may contact a switch member 46 positioned in a predetermined manner relative to the member 10. An axially enlarged rib 24 is created on the upper regions of the web member, spaced inwardly of the radial slots 18, to provide a contact focusing surface to act uniformly on switch 46, as shown in FIG. 6. A further advantage of the frustoconical configuration or taper of the outer surface of the legs is shown in FIG. 6, wherein even when the legs are fully, radially extended they still do not contact a cage region 44 of the motor armature 40. Thus, the switch member is free from any physical contact and the environment desired.

Figure 4:
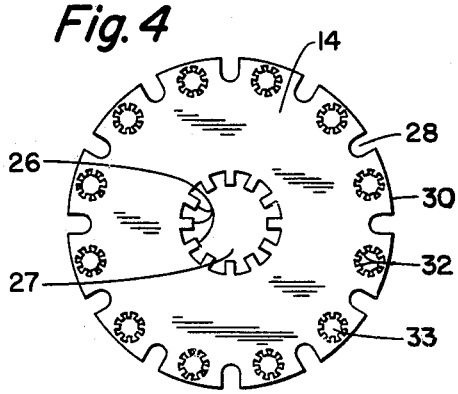
FIG. 4 is a top plan view of one embodiment of the web incorporated in the switch element of FIG. 1.

Turning back to FIG. 4, the sheet metal web 14 of the preferred embodiment is shown prior to the molding operation which creates the entire switch member 10 shown in FIG. 1. To unitize and to otherwise integrate the molded plastic members 12 and 16 to the spring steel, dome-like web or disc 14 (as shown in FIG. 2), a series of teeth-like protrusions 26 are formed in the inner periphery of a central aperture 27 in the web or disc 14 to lock and otherwise retain the molded plastic hub 12 relative thereto and a series of inwardly extending teeth 32 about the periphery of each aperture 33, tabs 30 are created to interact with and lock the individual molded legs 16 relative to the outer periphery of the web 14. It should be noted that the web 14 in FIG. 4 also includes slots 28 which are designed to register with the slots 18 in the finished product. However, it should be noted that these slots and resulting tabs 30 can be eliminated so long as the upper leg region extends inwardly beyond the outer periphery of the web or disc. The configuration shown in FIG. 4 serves to maximize the retention of the molded legs on the web.

Figure 5:
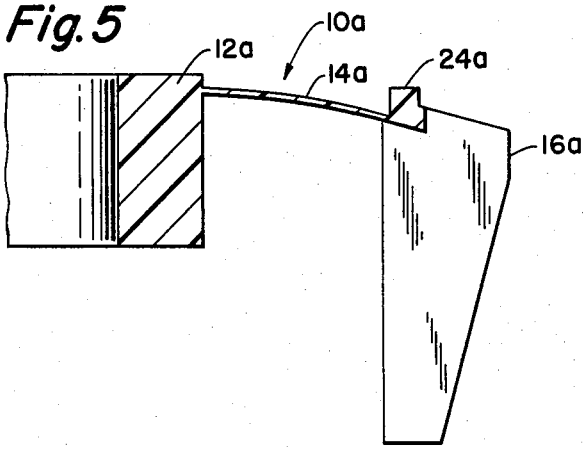
FIG. 5 is an enlarged, partial sectional view of a secondary embodiment of the switch element showing a unitary and integral hub, web and leg configuration.

While the preferred embodiment does show a stainless steel snap spring web (see FIG. 1), it should be understood that a similar result can be obtained by a completely integrally molded plastic member, such as that shown in FIG. 5. Element 10*a* includes a molded plastic hub 12*a* and a plurality of legs 16*a*. However, these legs and hub are integrally connected by a thin web of plastic 14*a* rather than the stainless steel web 14 in the preferred embodiment.

In summary, the invention just described is unique in that it provides a unitary, integral, centrifugal switching member, which is designed to first permit the pendantly extending legs to pivot freely relative to one another during a first stage of reaction to the centrifugal force, followed by a second stage reaction to the centrifugal force which results in a unified reaction on the outer periphery of the web. The structure thus defined creates a unified, snapping axial force on the outer periphery of the web, thus permitting a generally annular ridge to make reliable contact with a properly positioned switch.

From the foregoing, it is thus believed that the switch actuating member 10 and 10*a* meet the objects and advantages set forth above, as well as others; and it is contemplated that many changes may be made in the invention without departing from the spirit and scope of the invention as set forth in the claims below.

I claim:

1. In an actuator responsive to centrifugal forces for actuating a switching system in a motor assembly, an actuator member fixedly mounted on an armature shaft within the motor assembly, said actuator member comprising a hub section of a predetermined thickness and axial extent, a generally dome-like, circumferentially disposed, and substantially continuous web section extending radially outwardly from and axially in one direction relative to said hub section, said dome-like web section including a generally convex surface with a plurality of circumferentially spaced weight leg sections emanating from the outer periphery thereof, each of said weight leg sections extending axially relative to said axial extent of said hub in said one direction for a predetermined axial extent, and wherein the dome-like web includes a plurality of radially extending slots inwardly directed from the outer periphery of said actuator member, circumferentially extending means on said actuator member proximate said outer periphery for actuating a prepositioned switch mounted within said switching system, whereby as said armature shaft reaches a predetermined rotational speed said weight leg sections move radially outwardly causing said dome-like web to snap from a first position to a second position wherein said circumferentially extending means actuates said prepositioned switch when said dome-like web is in said second position.

2. An actuator member for the system described in claim 1, wherein each weight leg section has a predetermined thickness at its upper extremity, a portion of said thickness being freely extending and unconnected with the dome-like web and the adjacent legs and an inner portion of the thickness being integrally connected to the outer perimeter of the dome-like web.

3. An actuator member for the system described in claim 1, wherein each weight leg section has a differing thickness from their uppermost extremity to their lowermost extremity and the diameter at the lowermost extremity being less than the diameter at the uppermost region when said actuator is unbiased.

4. An actuator member for the system described in claim 1, wherein said circumferentially extending means includes a continuous raised rib of limited height and thickness formed on the actuator from the uppermost surface of the dome-like web and spaced inwardly from the outer perimeter of the actuator but generally directly above the innermost perimeter of the weight leg sections.

5. An actuator member for the system described in claim 1, wherein the radial extent of the slots is less than the radial extent of the uppermost extremity of the weight leg sections, each weight leg section tapering in thickness from its uppermost extremity to its lowermost extremity with the outer perimeter defined by the lowermost extremities of the weight leg sections being less than the outer perimeter defined by the uppermost extremities of the weight leg sections.

6. An actuator member for the system described in claim 1 wherein the hub and weight leg sections are injection molded to a dome-like web of spring metal.

7. An actuator member for the system described in claim 1, wherein the predetermined axial extent of the hub section is less than the predetermined axial extent of the weight leg sections.

8. An actuator member for the system described in claim 1, wherein the outermost peripheral regions of the weight leg sections are cantilever extending from the outermost perimeter of the dome-like web section, the uppermost outer surface of each said weight leg section in the composite being generally conical extending outwardly and downwardly from the outer periphery of the dome-like web.

9. An actuator member for the system described in claim 1, wherein the dome-like web section is of a predetermined radial extent greater than the thickness of the hub.

10. An actuator member for the system described in claim 1, wherein the weight leg sections, hub and dome-like web are formed as a one-piece molded thermoplastic device.

11. An actuator member for the system described in claim 1, wherein the weight leg sections are thermoplastic molded integrally to the outermost perimeter region of a dome-like web of thin spring metal, the uppermost region of the leg sections defining a predetermined radial extent inwardly from the outermost perimeter of said actuator member.

12. An actuator member for the system, described in claim 6, wherein the dome-like web includes a plurality of circumferentially spaced, radially extending slots equal in number to the number of legs, a similar number of apertures having non-circular inner peripheries each located intermediate adjacent slots and adapted to lock the injection molded leg sections to the outer periphery with a thin layer of plastic on the upper surface of the outer periphery of the dome-like web, the majority of the weight of each weight leg section extending from the lower surface of the dome-like web.

13. An actuator member for the system described in claim 6, wherein the dome-like web includes a centrally located aperture including radially extending slots serving to fixedly retain the hub when said hub is molded to the inner periphery of the dome-like web.

* * * * *